US005115706A

United States Patent [19]

Aluisi

[11] Patent Number: 5,115,706

[45] Date of Patent: May 26, 1992

[54] ERGONOMIC DRUM ASSEMBLY

[76] Inventor: Alan L. Aluisi, 44 S. Adams #733, Denver, Colo. 80209

[21] Appl. No.: 319,252

[22] Filed: Mar. 3, 1989

[51] Int. Cl.[5] ..... G10H 5/00

[52] U.S. Cl. ..... 84/723; 84/DIG. 12

[58] Field of Search ..... 84/671, 702, 703, 718, 84/723, 725, 730, 733, 734, 743, DIG. 12, DIG. 24

[56] References Cited

U.S. PATENT DOCUMENTS

| | | | |
|---|---|---|---|
| 3,439,568 | 4/1969 | Griffith | 84/718 X |
| 3,712,951 | 1/1973 | Rickard . | |
| 3,956,959 | 5/1976 | Ebihara et al. . | |
| 4,214,504 | 7/1980 | Rex . | |
| 4,226,156 | 10/1980 | Hyakutake . | |
| 4,227,049 | 10/1980 | Thomson et al. . | |
| 4,479,412 | 10/1984 | Klynas . | |
| 4,581,972 | 4/1986 | Hoshino . | |
| 4,648,302 | 3/1987 | Bozzio . | |
| 4,679,479 | 7/1987 | Koyamato . | |
| 4,691,611 | 9/1987 | May . | |
| 4,732,070 | 3/1988 | Yamashita . | |

FOREIGN PATENT DOCUMENTS

| | | |
|---|---|---|
| 114494 | 4/1986 | Japan . |

OTHER PUBLICATIONS

Advertisement for "drumKAT Midi Controller".

*Primary Examiner*—Stanley J. Witkowski
*Attorney, Agent, or Firm*—William P. O'Meara

[57] ABSTRACT

A drum assembly comprising: a center drum pad; first, second, third, fourth, fifth, and sixth peripheral drum pads arranged in encompassing relationship about the center drum pad; electronic percussion synthesizer operably connected to each of the drum pads for producing predetermined percussion sounds in response to the striking of the drum pads.

10 Claims, 2 Drawing Sheets

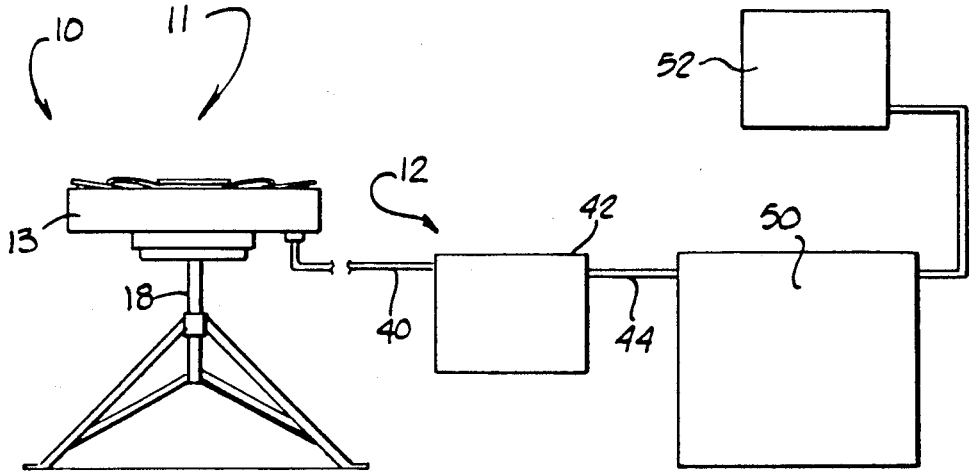
FIG. 1
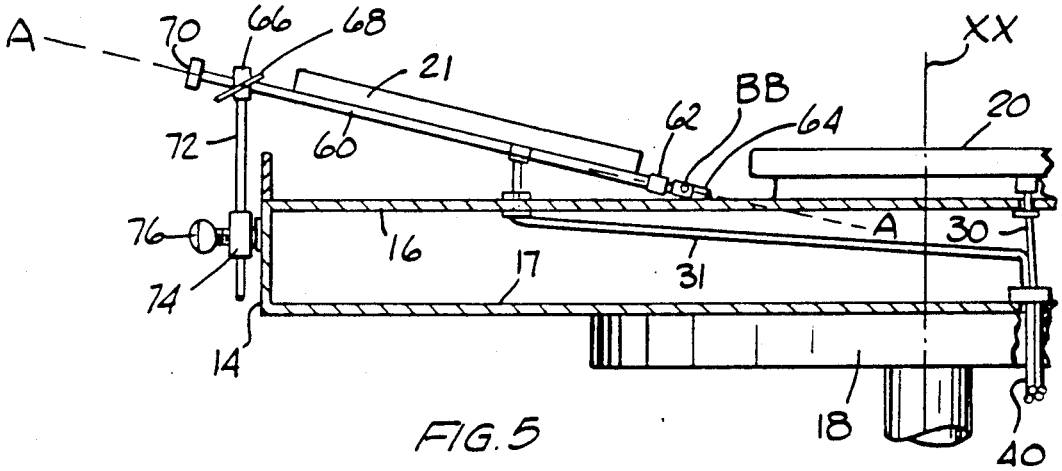
FIG. 5
FIG. 6
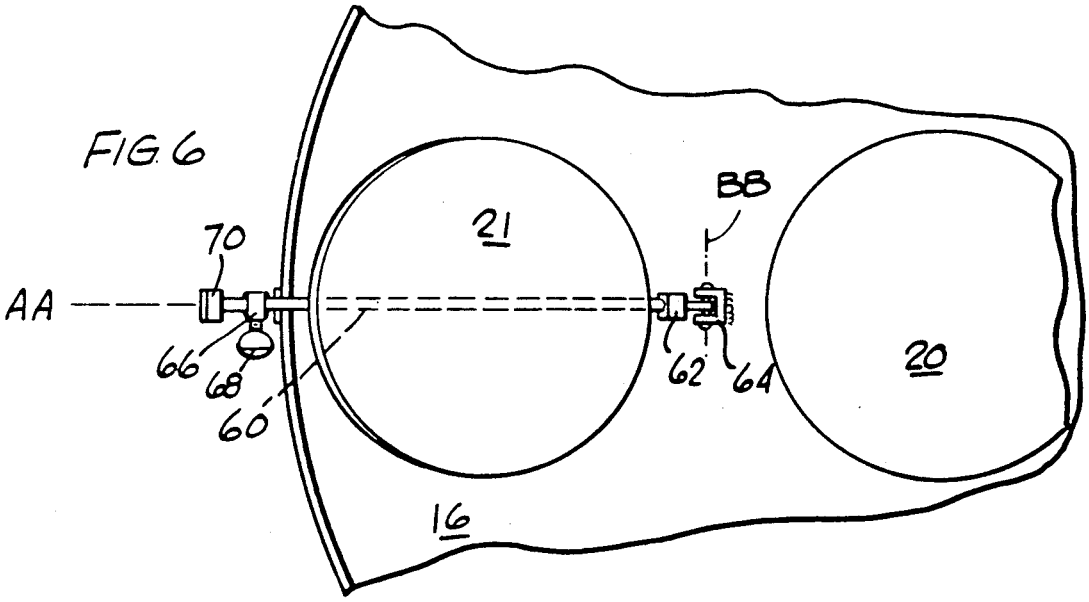

ERGONOMIC DRUM ASSEMBLY

BACKGROUND OF THE INVENTION

The present invention relates generally to electronic percussion synthesizers and, more particularly, to an electronic percussion synthesizer having an ergometrically designed drum head assembly for producing snare and tom-tom drum notes.

In conventional drum sets of the type used by jazz and rock musicians, a snare drum forms the center piece of the drum set and tom-tom drums are positioned in a semicircular pattern around the snare drum on the side opposite from the drummer. All other non-drum instruments such as cymbals and the like are positioned above and around the snare and tom-tom drums. The tom-toms are conventionally arranged with the individual tom-toms descending in pitch from the left side of the set to the right side of the set.

It is applicant's discovery that this traditional snare/-tom-tom arrangement unnecessarily limits the snare and tom-tom note patterns which might be executed by a drummer. The semicircular arrangement and linear pitch pattern of the tom-toms often causes a drummer to resort to "cross-sticking", i.e. crossing one hand over the other hand and back again, in order to play appropriate drums in a pattern. Such cross-sticking causes torso contortions which impede the accurate and expressive execution of patterns or beats. In order to avoid the exaggerated physical movements associated with cross-sticking, drummers sometimes change the sticking order of ongoing patterns in order to start an approaching pattern with the appropriate drumstick and on the appropriate drum. This change in sticking order is referred to as "lead-hand switching". The mental effort which is required to execute lead-hand switching greatly impedes new and spontaneous drum pattern construction and execution.

In modern drum sets, electronic drum pads are sometimes substituted for traditional drums. However, the basic physical arrangement and pitch order of the snare/tom-tom drum configuration has remained essentially unchanged. For example, rather than providing conventional tom-toms arranged in a semicircle around a snare drum, a "midipad" consisting of a linear array of individual drum pads arranged in descending pitch order from left-to-right is positioned next to the snare drum and is used to electronically reproduce tom-tom notes. The linear arrangement of the various tom-tom pads on the "midipad" leads to the same basic sticking problems that are experienced on a traditional drum set.

OBJECTS OF THE INVENTION

It is an object of the present invention to provide a new, ergonomically designed, snare/tom-tom drum configuration which eliminates the need to cross-stick or change lead hands while playing the most basic and complex snare/tom-tom drum patterns, and which enables the playing of a vast number of new, complex snare and tom-tom drum patterns and patterns involving a whole drum set which includes cymbals and other non-drum voices.

It is another object of the invention to provide a snare/tom-tom drum configuration which enables drummers to execute cross-sticking, when required, much more easily than on conventional snare/tom-tom drum sets, using an efficient alternating circular motion of the arms and hands.

It is another object of the invention to provide a snare/tom-tom drum head configuration in a single, compact unit.

It is another object of the invention to provide a snare/tom-tom drum configuration consisting of electronic drum pads which range in diameter from 3 to 6 inches.

It is another object of the invention to provide a snare/tom-tom drum configuration consisting of six tom-tom drum pads arranged in an evenly-spaced, circular relationship about a central snare drum pad.

It is another object of the invention to provide a snare/tom-tom drum configuration in which tom-tom drum pads may be actuated to electronically produce tom-tom-like sounds such as conventional tom-tom sounds, log drums, and Latin timbales.

It is another object of the invention to provide a snare/tom-tom drum configuration in which a snare drum pad may be actuated to electronically produce different snare-type sounds such as piccolo snares and military field drums.

It is another object of the invention to provide a snare/tom-tom drum configuration in which the tom-tom pads are inclined towards the snare pad.

It is another object of the invention to provide a snare/tom-tom drum configuration in which the tom-tom pad inclination angle is adjustable about two different axes.

It is another object of the invention to provide a snare/tom-tom drum configuration in which a different three-tom-tom-drum set arranged in descending pitch order is available to each hand of the drummer without cross-sticking.

It is another object of the invention to provide a snare/tom-tom drum configuration upon which drummers can execute with greater ease and expression every type of snare and tom-tom and whole set pattern which is now played on existing drum or pad sets.

It is another object of the invention to provide a snare/tom-tom drum configuration which may be played with such speed and accuracy as to simulate the sound produced on a programmed electronic drum machine.

SUMMARY OF THE INVENTION

The present invention may comprise a drum assembly including: a) a center drum pad; b) first, second, third, fourth, fifth, and sixth peripheral drum pads arranged in encompassing relationship about said center drum pad; c) electronic percussion synthesizer means operably connected to each of said drum pads for producing predetermined percussion sounds in response to the striking of said drum pads.

The invention may also comprise a method of providing percussion music comprising: a) arranging six peripheral drum pads in an evenly-spaced, circular pattern about a central drum pad; b) connecting the drum pads to a musical synthesizer; c) adjusting the musical synthesizer so as to provide: a tom-tom sound of a first pitch with a first peripheral drum pad, a tom-tom sound of a second pitch lower than said first pitch with a second peripheral drum pad positioned adjacent said first drum pad, a tom-tom sound of a third pitch lower than said second pitch with a third peripheral drum pad positioned adjacent said first drum pad, a tom-tom sound of a fourth pitch lower than said third pitch with fourth peripheral drum pad positioned adjacent said second drum pad, a tom-tom sound of a fifth pitch lower than said fourth pitch with a fifth peripheral drum pad positioned adjacent said third drum pad, a sixth tom-tom pitch lower than said fifth tom-tom pitch with a sixth peripheral drum pad positioned adjacent said fourth and sixth peripheral drum pads; providing a first snare sound outside of the pitch range defined by said first and sixth tom-tom pitches in association with said central drum pad; d) striking said drum pads with a pair of drumsticks in a selected sequence.

BRIEF DESCRIPTION OF THE DRAWING

An illustrative and presently preferred embodiment of the invention is shown in the accompanying drawings in which:

FIG. 1 is a schematic illustration of an electronic drum assembly.

FIG. 5 is a cross-sectional elevation view of a portion of a drum head assembly having an adjustable drum pad.

FIG. 6 is a partial top plan view of the drum head assembly of FIG. 5.

DETAILED DESCRIPTION OF THE INVENTION

Figure 2:
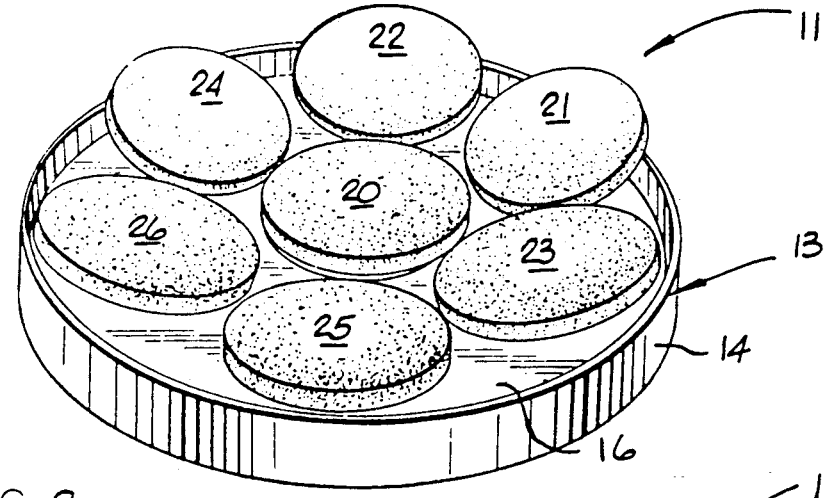
FIG. 2 is a perspective view of a drum head assembly.
Figure 3:
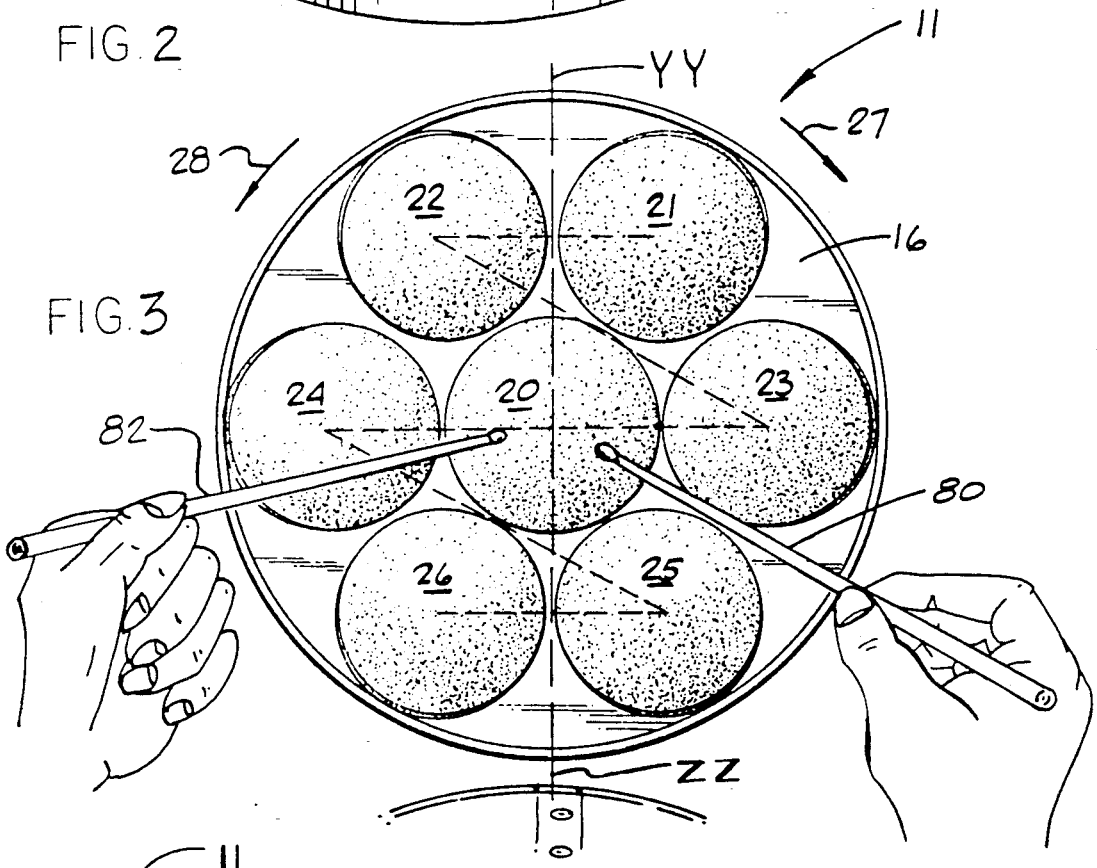
FIG. 3 is a top plan view of the drum head assembly of FIG. 2.
Figure 4:
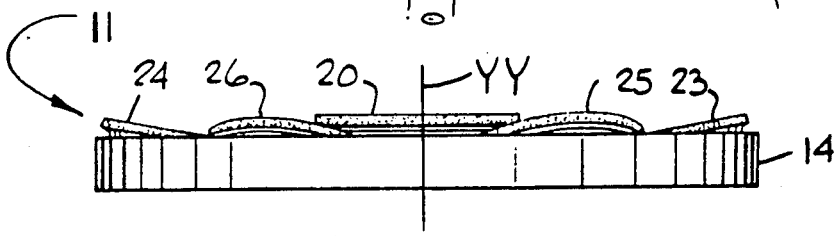
FIG. 4 is a side elevation view of the drum head assembly of FIGS. 2 and 3.

FIG. 1 schematically illustrates a drum assembly 10 comprising a drum head assembly 11 connected to an electronic synthesizer assembly 12. The drum head assembly 11, as best illustrated in FIGS. 2-4, comprises a housing unit 13 which may have a cylindrical sidewall 14 and a planar, circular top wall 16. The housing unit may also comprise a planar bottom wall 17, FIG. 5, which may be attached to a conventional, adjustable-height support stand assembly 18. In one preferred embodiment of the invention, the top wall 16 may have a diameter of approximately 15 to 17 inches and preferably about 16 inches, and the cylindrical sidewall 14 may comprise an axial dimension of approximately 4 inches. The housing unit may be constructed from high-strength plastic or other suitable material.

As illustrated in FIGS. 2 and 3, the drum head assembly 11 may comprise a central drum pad 20 and six peripheral drum pads 21-26 arranged in evenly-spaced, circular relationship about the central drum pad. In one embodiment of the invention, the drum pads range in diameter from 4 inches to 6 inches, and are most preferably approximately 5 inches in diameter. In a preferred embodiment of the invention, each of the peripheral drum pads 21-26 has a central point which lies approximately on a cylindrical locus which is concentric with the housing unit 11 and which has a cylindrical diameter of between 4 inches and 6 inches and, most preferably, approximately 5 inches. Each drum pad may comprise a conventional electronic drum pad of the type having a pressure transducer mounted on the underside of a strike plate, such as described in U.S. Pat. Nos. 4,479,412 and 4,581,972, which are hereby specifically incorporated by reference for all that is disclosed therein. In one preferred embodiment of the invention which is presently the best mode contemplated, each drum pad 20-26 comprises a Dauz drum pad, which is commercially available through Dauz Designs, 1706 North Vine Street #333, Hollywood, Calif., 90028. As illustrated in FIGS. 2-4, the central drum pad 20 is arranged with its striking surface parallel to the housing top surface 16 and the peripheral drum pads are oriented with their striking surfaces at a fixed angle of inclination with respect to the central drum pad 20. Each peripheral drum pad is preferably downwardly and inwardly inclined between 0° and 30° with respect to the central drum pad 20 and, most preferably, is inclined between 10° and 20° depending upon drum pad placement.

In another embodiment, as illustrated in FIGS. 5 and 6, each peripheral drum pad may be adjustably positioned about two different axes. Each peripheral drum pad, e.g. 21, is fixedly mounted on a shaft 60 having a shaft central axis of rotation AA. Shaft 60 has one end fixedly mounted in a swivel assembly 62 which enables swiveling movement of the shaft 60 about axis AA. The swivel assembly 62 is, in turn, attached to a hinge assembly 64 which is mounted on the drum housing top wall 16. The hinge assembly 64 enables pivotal movement of the swivel assembly 62 and shaft 60 about horizontal pivot axis BB. Axis AA extends generally radially with respect to the housing unit 13 central axis XX, and axis BB extends perpendicular to axis AA. A second end of shaft 60 is received through a ring assembly 66 which is provided with a set screw 68 for locking shaft 60 at a selected rotational position therein. A knob 70 may be provided at the end of shaft 60 to facilitate rotational positioning of shaft 60 within ring assembly 66. Ring assembly 66 is fixedly mounted at the end of a vertical support shaft 72 which is, in turn, received in a second ring assembly 74 fixedly mounted on the sidewall 14 of the housing unit 13. A set screw 76 is provided with the second ring assembly which enables vertical shaft 72 to be held in fixed relationship therewith at a height selected by the drummer. Thus, the associated drum pad 21 is adjustably positionable about axis AA and also about axis BB. The relative inclination of the drum pad about axis BB will effect the amount of drumstick rebound toward central pad 20, the greater the angle of inclination, the greater the tendency of the drum stick to rebound toward central drum pad 20 after a drum strike on an associated peripheral pad, e.g. 21. Angular adjustment about axis AA allows each drummer to contour the peripheral drum pads to accommodate his particular physiology or drumming style.

As illustrated in FIG. 5, each drum pad has an electric lead, e.g. 30, 31, associated therewith which transmits an electronic signal in response to a drum head strike. The leads 30, 31 may be collected in a cable assembly 40 extending between the drum head assembly and an electronic synthesizer assembly 12. In one preferred embodiment of the invention, the electronic synthesizer assembly comprises an electronic interface box 42 which receives the individual electronic inputs from the various pads 20-26. A second cable 44, which carries leads corresponding to each of the pads 21-26, connects the interface box 42 with a conventional drum machine 50. The drum machine 50 is, in turn, connected to suitable speakers 52. In one preferred embodiment of the invention which is presently the best mode contemplated, the interface box comprises a Roland PM 16 Interface, available from Roland Corp. U.S., 7200 Dominion Circle, Los Angeles, Calif., 90040; and the drum machine comprises an HR 16 Digital Drum Machine, available from Alesis Corp., 3630 Holdrege Avenue, Los Angeles, Calif., 90016. The speakers 52 are preferably commercially available performance-quality speakers. The connection of electronic drum pads to electronic sythesizer assemblies is conventional and well-known in the art.

A drum machine such as the HR 16 Digital Drum Machine is capable of creating multiple pre-programmed sounds. In the preferred embodiment, the drum machine is programmed such that the peripheral drum pads 21-26 each produce a tom-tom-type sound and the central drum pad 20 produces a snare drum-type sound. In one preferred embodiment of the invention, the snare drum sound lies outside of the pitch range defined by the first and sixth peripheral drum pads and is a much higher pitch and of a different timbre than the peripheral drum pads and provides sonic contrast thereto. In a preferred embodiment of the invention which is presently the best mode contemplated, the drum machine is programmed such that the pitch order of the peripheral drum pads descends in pitch from drum pads 21-26 in a zig-zag pattern, i.e. drum pad 21 has the highest pitch and drum pad 26 has the lowest pitch and the peripheral pads are arranged as illustrated in FIG. 3 in such a manner that the highest pitch peripheral drum pad 21 is positioned circumferentially next adjacent to the second and third highest pitch peripheral drum pads 22, 23; the fourth highest pitch peripheral drum pad 24 is positioned circumferentially next adjacent to the second and sixth highest pitch peripheral drum pads 22, 26; and the fifth highest pitch peripheral drum pad 25 is positioned circumferentially next adjacent to the third and sixth highest pitch peripheral drum pads 23, 26. It will thus be seen that the drum head assembly is divisible by a plane of bilateral symmetry YY into a first circular half including the first, third and fifth peripheral pads 21, 23 and 25 arranged in a descending pitch order in a first circumferential direction 27; and a second circular half including the second, fourth and sixth peripheral drum pads 22, 24, 26 arranged in descending pitch order in a second circumferential direction 28 opposite the first circumferential direction 27. Thus, it will be seen that a drummer having his solar plexus ZZ aligned with the plane of bilateral symmetry YY is enabled to strike a first set of three peripheral drum pads, e.g. 21, 23, 25, arranged in descending pitch order and also the central drum pad 20 with a drumstick 80 held in one hand and is able to strike a second set of three peripheral drum pads, e.g. 22, 24, 26, arranged in descending pitch order and also the central drum pad 20 with a drumstick 82 held in his other hand without moving either of his drumsticks across the plane of bilateral symmetry XX.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A drum assembly comprising:

a) a center drum pad;

b) first, second, third, fourth, fifth, and sixth peripheral drum pads arranged in encompassing relationship about said center drum pad;

c) electronic percussion synthesizer means operably connected to each of said drum pads for producing predetermined percussion sounds in response to the striking of said drum pads;

wherein said synthesizer means produces first, second, third, fourth, fifth, and sixth percussion sounds of succeedingly lower pitch in association with said first, second, third, fourth, fifth, and sixth peripheral drum pads; said synthesizer means producing a percussion sound in association with said central drum pad which is different in pitch from said percussion sounds produced in association with said peripheral drum pads; said first drum pad being positioned circumferentially next adjacent to said second and third drum pads; said fourth drum pad being positioned circumferentially next adjacent to said second and sixth drum pads; said fifth drum pad being positioned circumferentially next adjacent to said third and sixth drum pads;

whereby said drum assembly is divisible by a plane of bilateral symmetry into a first circular half including said first, third and fifth peripheral pads arranged in descending pitch order in a first circumferential direction and a second circular half including said second, fourth, and sixth peripheral drum pads arranged in descending pitch order in a second circumferential direction opposite said first circumferential direction;

whereby a drummer having his solar plexus aligned with said plane of bilateral symmetry is enabled to strike a first set of three peripheral drum pads arranged in descending pitch order and said central drum pad with a drumstick held in one hand and is able to strike a second set of three peripheral drum pads arranged in descending pitch order and said central drum pad with a drumstick held in a second hand without moving either of said drumsticks across said plane of bilateral symmetry.

2. A drum assembly comprising:

a) a center drum pad;

b) first, second, third, fourth, fifth, and sixth peripheral drum pads arranged in encompassing relationship about said center drum pad;

c) electronic percussion synthesizer means operably connected to each of said drum pads for producing predetermined percussion sounds in response to the striking of said drum pads;

d) wherein said synthesizer means produces first, second, third, fourth, fifth, and sixth tom-tom sounds of succeedingly lower pitch in association with said first, second, third, fourth, fifth, and sixth peripheral drum pads; said synthesizer producing a snare sound in association with said central drum pad which is different in pitch from said tom-tom sounds produced in association with said peripheral drum pads;

e) said first drum pad being positioned circumferentially next adjacent to said second and third drum pads; said fourth drum pad being positioned circumferentially next adjacent to said second and sixth drum pads; said fifth drum pad being positioned circumferentially next adjacent to said third and sixth drum pads;

whereby said drum assembly is divisible by an plane of bilateral symmetry into a first circular half including said first, third and fifth peripheral pads arranged in descending pitch order in a first circumferential direction and a second circular half including said second, fourth, and sixth peripheral drum pads arranged in descending pitch order in a second circumferential direction opposite said first circumferential direction;

whereby a drummer having his solar plexus aligned with said plane of bilateral symmetry is enabled to strike first set of three peripheral drum pads arranged in descending pitch order and said central drum pad with a drumstick held in one hand and is able to strike a second set of three peripheral drum pads arranged in descending pitch order and said central drum pad with a drumstick held in a second hand without moving either of said drumsticks across said plane of bilateral symmetry.

3. A drum assembly comprising:

a) a center drum pad;

b) first, second, third, fourth, fifth, and sixth peripheral drum pads arranged in encompassing relationship about said center drum pad;

c) electronic percussion synthesizer means operably connected to each of said drum pads for producing predetermined percussion sounds in response to the striking of said drum pads;

wherein each of said drum pads comprises a generally circular shape;

wherein each of said drum pads comprises a diameter between 4 inches and 6 inches;

wherein each of said peripheral drum pads is downwardly and inwardly inclined whereby a drumstick striking a peripheral drum pad is deflected towards said center pad.

4. The invention of claim 3 wherein said angle of downward and inward inclination of each drum pad relative to the surface of said central drum pad is between 0° and 30°.

5. The invention of claim 4 wherein said angle of inclination is approximately 10° to 20°.

6. A drum assembly comprising:

a) a center drum pad;

b) first, second, third, fourth, fifth, and sixth peripheral drum pads arranged in encompassing relationship about said center drum pad;

c) electronic percussion synthesizer means operably connected to each of said drum pads for producing predetermined percussion sounds in response to the striking of said drum pads;

wherein each of said drum pads comprises a generally circular shape;

wherein each of said drum pads comprises a diameter between 4 inches and 6 inches;

wherein the relative inclination of a striking surface of at least one peripheral drum pad relative a striking surface of said central drum pad is adjustable about at least one axis.

7. A drum assembly comprising:

a) a center drum pad;

b) first, second, third, fourth, fifth, and sixth peripheral drum pads arranged in encompassing relationship about said center drum pad;

c) electronic percussion synthesizer means operably connected to each of said drum pads for producing predetermined percussion sounds in response to the striking of said drum pads;

wherein each of said drum pads comprises a generally circular shape;

wherein each of said drum pads comprises a diameter between 4 inches and 6 inches;

wherein the relative inclination of a striking surface of at least one peripheral drum pad relative a striking surface of said central drum pad is adjustable about two axes.

8. A drum assembly comprising:

a) a center drum pad;

b) first, second, third, fourth, fifth, and sixth peripheral drum pads arranged in encompassing relationship about said center drum pad;

c) electronic percussion synthesizer means operably connected to each of said drum pads for producing predetermined percussion sounds in response to the striking of said drum pads;

wherein each of said drum pads comprises a generally circular shape;

wherein each of said drum pads comprises a diameter between 4 inches and 6 inches;

wherein the center of each of said peripheral drum pads lie generally on a common cylindrical locus having a diameter between 4 inches and 6 inches.

9. The invention of claim 8, wherein the common cylindrical locus has a diameter of approximately 5 inches.

10. The invention of claim 9, all of said drum pads being mounted on a unitary circular support member.

* * * * *